United States Patent [19]

Wlodkowski et al.

[11] 4,363,462

[45] Dec. 14, 1982

[54] RECOVERABLE FORMWORK PART FOR FORMING THE ANCHORING LOCATION OF A TENDON IN A CONCRETE STRUCTURAL COMPONENT

[75] Inventors: Johann Wlodkowski; Dieter Jungwirth, both of Munich, Fed. Rep. of Germany

[73] Assignee: Dyckerhoff & Widmann Aktiengesellschaft, Munich, Fed. Rep. of Germany

[21] Appl. No.: 227,136

[22] Filed: Jan. 21, 1981

[30] Foreign Application Priority Data

Jan. 26, 1980 [DE] Fed. Rep. of Germany ... 8002045[U]

[51] Int. Cl.[3] ..... E04G 17/08; E04G 17/04; E04G 11/06

[52] U.S. Cl. ..... 249/190; 24/115 M; 24/122.6; 52/223 L; 52/230; 249/213; 249/217; 249/219 R; 425/111

[58] Field of Search ..... 249/83, 85, 177, 178, 249/205, 111, 94, 96, 43, 217, 97, 190, 1, 213, 219 R, 217; 425/111; 52/230, 223 R, 223 L; 24/115 M, 122.6, 115 R, 122.3

[56] References Cited

U.S. PATENT DOCUMENTS

| | | | |
|---|---|---|---|
| 3,605,361 | 9/1971 | Howlett et al. | 24/122.6 |
| 3,833,706 | 9/1974 | Edwards | 52/230 |
| 3,877,113 | 4/1975 | Reyes | 24/115 M |
| 3,956,797 | 5/1976 | Brandestini et al. | 52/230 |

FOREIGN PATENT DOCUMENTS

| | | |
|---|---|---|
| 2176273 | 1/1976 | Fed. Rep. of Germany . |
| 482080 | 1/1970 | Switzerland . |

*Primary Examiner*—Willard E. Hoag

*Attorney, Agent, or Firm*—Toren, McGeady & Stanger

[57] ABSTRACT

The formwork for a concrete structural member includes a recoverable formwork part. This recoverable part has an axially elongated sheath which closely encloses a tendon over a relatively long portion of the length of the sheath. A cup-shaped part formed integrally with the sheath is arranged to form at least a portion of a recess in the concrete member. When assembled on the formwork, one end of the sheath is arranged to be located within the concrete when it is poured and the other end is located on the exterior of the formwork. The cup-shaped part is located intermediate the ends of the sheath and just inside the formwork. A member is engageable with the sheath for attaching it to the formwork.

5 Claims, 11 Drawing Figures

RECOVERABLE FORMWORK PART FOR FORMING THE ANCHORING LOCATION OF A TENDON IN A CONCRETE STRUCTURAL COMPONENT

SUMMARY OF THE INVENTION

The present invention is directed to a recoverable formwork part for forming the location of a tendon anchoring member in a concrete structural member. The tendon is secured by an anchoring member which has a central passage for the tendon. The recoverable part consists of an elongated tubular sheath which encloses the tendon in its position within the formwork and a cup-shaped part which is arranged to form the recess in the concrete. The recoverable part can be connected to the formwork for the concrete structural member.

In a known formwork part of this general type, the cup-shaped part forming a recess, penetrates the formwork through a large hole or opening. Within the formwork, the part continues as a tubular extension, penetrating the anchoring member and the extension includes a tubular transition piece for connection to the metal sheath of the tendon. Although an anchoring member can be secured to the recess forming part, it is difficult to align the entire formwork part exactly with the longitudinally axis of the tendon to be inserted later, because the tubular sheath which forms the hollow space for the tendon creates a relatively wide channel for use with tendons of various types. Further it is difficult to attach the cup-shaped part, which forms the recess, to the formwork, note German Utility Model No. 7,602,125.

It is also known to secure the part which forms the recess by another part having a smaller diameter which extends through a hole in the formwork, note Swiss Pat. No. 482,080. In such an arrangement the anchoring member secured to the recess forming part can be fixed relative to the formwork, however, an exact centering of the formwork part, aligned with the longitudinal axis of the tendon, cannot be accomplished with this embodiment, because the part including the recess forming part and the anchoring member rests against the tendon only at one point.

To avoid the uneven stresses on the tendons in the anchorage region which, in particular, signifies reduction in the vibration strength, it is an absolute necessity to center the anchoring members exactly not only with respect to the tendon axis but also to align the support surface of the anchoring member with respect to the concrete exactly perpendicularly to the axis of the tendon. This is particularly important when the anchoring member is not installed with the formwork but is inserted into the recess formed by the part after the concrete member is formed.

Tendons for prestressed concrete are frequently installed without composite action, that is, without bonding to the surrounding concrete. In such an installation, the tendons must be sufficiently protected against corrosion, such as by enclosing them in a plastic coating. In such an arrangement, the tendon can be provided with a corrosion protection when it is produced and it is unnecessary to provide the enclosing covering at a construction site which presents certain difficulties. When such an arrangement is used, however, it must be assured that the formwork part for defining the anchoring region correctly joins the corrosion protection jacket on the tendon.

Therefore, the primary object of the present invention is to provide a recoverable formwork pat of a type described above which permits exact centering and alignment of the anchoring member when it is installed in the formwork along with the recoverable part as well as when it is placed in position after the concrete is poured. The recoverable formwork part can be used for tendons to be installed with or without composite action and which remains securely in place when the concrete is being poured with a minimum of detachable parts.

In accordance with the present invention, the recoverable formwork part includes an elongated tubular sheath which provides guidance for the tendon over a considerable part of the axial length of the sheath. Further the sheath extends through the formwork and can be attached to the formwork. The recess forming part is provided on the sheath located approximately in the center thereof between its ends.

Advantageously, the cup-shaped part which forms the recess has a bottom portion spaced inwardly from the formwork which extends at a right angle to the axis of the sheath. It is advantageous if the anchoring member can be connected with the recess forming part in a form-locking manner so that the two can be inserted into the formwork as a unit. The bottom of the part which forms the recess, that is the portion spaced inwardly of the form, has a thicker construction with a circumferential groove in the end face directed away from the formwork so that the anchoring member can be inserted into the groove. An external thread can be provided on the anchoring member with a complementary thread formed in the circumferential groove for connecting the anchoring member to the recess forming part. The end of the passage formed by the tubular sheath within the portion of the formwork which is to receive concrete can have an increased diameter for accepting a tendon provided with a corrosion protection jacket.

It is also possible to provide the sheath, at its end within the formwork into which the concrete is poured, with a reduced outside diameter so that it can be inserted into a sleeve of sheet metal, plastic or the like, which surrounds the tendon.

The part for forming the recess in the concrete can also include an element formed of a material which is easy to shape, for instance, polystyrene, and it can be combined with the cup-shaped part and located between the cup-shaped part and the inside of the formwork.

Finally, the portion of the sheath which extends outwardly from the formwork can be provided with an external thread onto which a connecting nut can be fitted.

An essential feature of the formwork part embodying the present invention involves the provision of the passage through the tubular sheath, which extends through the anchoring member and surrounds the tendon, for affording guidance for the tendon. Since the sheath guides the tendon over a relatively long axial portion of its length, the recess forming part formed integrally with the sheath is positioned so that it is exactly aligned with the tendon. This exactly aligned position is also assumed by the anchoring member when it is placed on the surface formed by the recess forming part or when it is connected to the recess forming part during the construction of the formwork.

Since the tubular sheath portion of the formwork part surrounds the tendon and can be connected at one end to the metal sleeve for the tendon or to the corrosion protection jacket for the tendon and, since the sheath extends outwardly from the formwork, during the installation of the formwork and until the tendon is tensioned, the formwork part provides corrosion protection in the anchorage region. Furthermore, because the formwork part passes through a relatively small hole in the formwork it can be relatively easily attached.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1A:
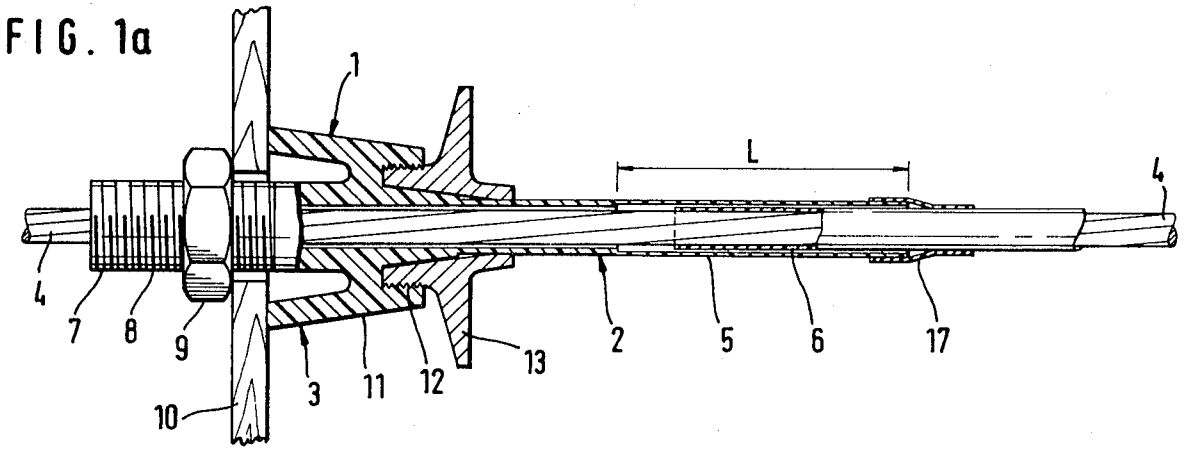
FIGS. 1*a* and 1*b* illustrate axial sections through the location at which a tendon, without composite action, is anchored by an anchoring member embedded in concrete, with FIG. 1*a* showing the formwork in the assembled state before concrete is poured and with FIG. 1*b* showing the tendon in the anchored state after the concrete is poured and the formwork removed.
Figure 1B:
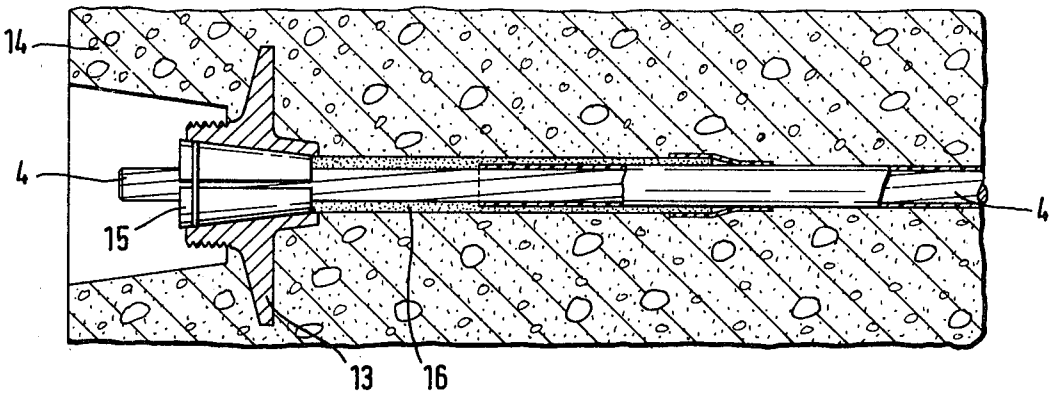
Figure 2A:
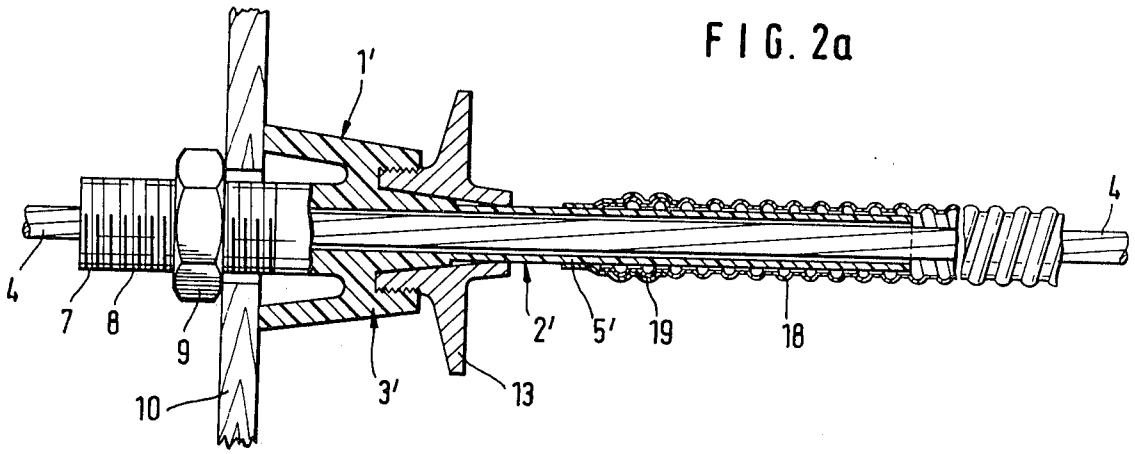
FIGS. 2*a* and 2*b* display axially extending sections, similar to FIGS. 1*a* and 1*b*, at the location at which a tendon, with composite action, is anchored in an anchoring member embedded in concrete.
Figure 2B:
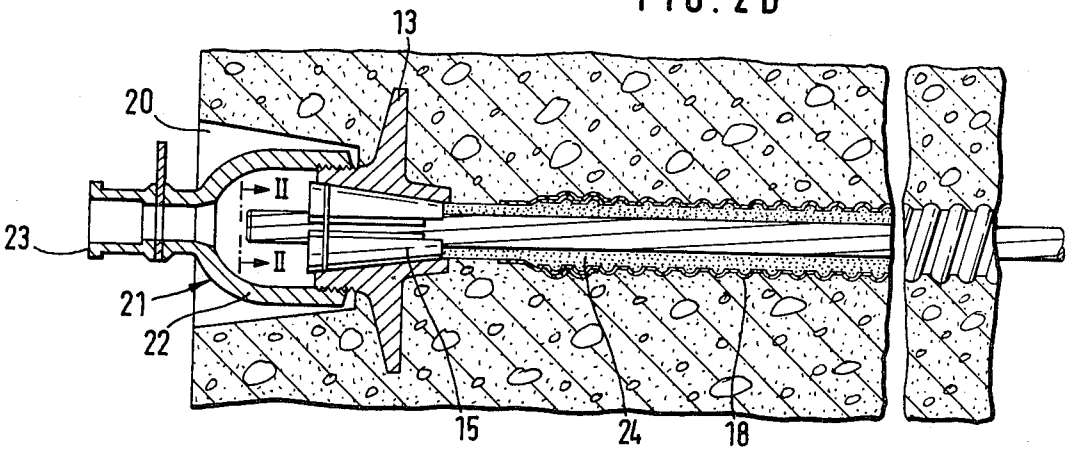
Figure 2C:
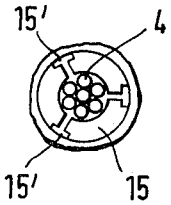
FIG. 2*c* is an end view of a portion of the arrangement shown in FIG. 2*b* taken along the line II—II in that figure.

In FIGS. 1*a*, 1*b* and 2*a*, 2*b* the invention is shown incorporated into a tendon anchoring system including an anchoring member, embedded in concrete, and a tendon without composite action and with composite action, that is, without composite action where the tendon is bonded to the concrete and with composite action where the tendon is separated from bonding action with the concrete. FIGS. 1*a* and 2*a* show the assembled state of the formwork before the concrete is poured while FIGS. 1*b* and 2*b* show a concrete structural member after prestressing with the formwork removed.

The present invention is directed to a formwork part 1 which includes an elongated tubular sheath 2 and a cup-shaped part 3 for forming a recess within the concrete poured into the formwork. The cup-shaped part 3 is formed integrally with the tubular sheath 2. The tubular sheath has one end located within the formwork 10 and its other end, as viewed in FIG. 1*a*, extends outwardly from the formwork. The sheath 2 surrounds the tendon, shown as a strand 4, over a relatively long portion of its length with limited play so that the entire formwork part 1 is exactly guided on the strand 4. Preferably, the formwork part 1 is constructed of a plastics material.

Different portions of the sheath 2 perform different tasks. At the end 5 within the formwork, the tendon extends into the sheath 2 and the sheath is expanded, that is, it has a larger inside diameter, so that the corrosion resistant jacket 6 on the strand 4 enters into the end 5 of the sheath. Usually, the corrosion protection jacket 6 is formed from a polyethylene tube which is pushed or extruded on to the strand, after the strand is provided with a corrosion resistant coating, such as a fat or wax. The length L of the increased inside diameter of the sheath 2 must be such that possible shrinkage of the corrosion protection jacket 6 can be adsorbed in the axial direction. Such shrinkage is often due to temperature differences which occur during the period between the installation of the formwork and the tensioning of the tendons. A sealing band 17 closes the transition section between the inner end of the sheath 2 and the strand 4.

Another axially extending section 7 of the sheath extends outwardly through the formwork 10. The strand 4 extends outwardly from the end of the section 7. An external thread 8 is provided on the outside surface of the section 7 and a nut 9 is screwed onto the thread 8 and secures the formwork part 1 to the formwork 10. The action of the nut 9 screwed onto the thread 8 on the section 7 of the sheath 2, draws the cup-shaped part 3 against the inside surface of the formwork 10 and affords a perfect attachment of the formwork part 1 when the tendon extends through the formwork at a right angle.

The end of the cup-shaped part 3 spaced inwardly from the inside surface of the formwork end has an increased thickness bottom 11 with the end face of the bottom containing a circumferential groove 12. Anchoring member 13 is inserted into the groove 12. To secure the anchoring member 13 in the circumferential groove 12 both parts are provided with complementary threads or else with a bayonet lock or similar connecting means. The connection between the two elements must be form-locking and be sufficiently strong so that no changes in position occur when the anchoring system is installed and when the concrete is poured into the formwork. The connection, however, must also be arranged so that the formwork part 1 can be removed easily after the concrete poured into the formwork has set.

In FIG. 1*b* the concrete structural member 14 is shown with the formwork part 1 and the formwork 10 removed. The anchoring member is firmly embedded in the concrete. The tendon or strand 4, extending through the frusto-conical opening in the anchoring member 13, is secured by anchoring wedges 15. The hollow space around the tendon, remaining after the removal of the formwork part 1 including the sheath 2 inwardly of the anchoring member 13 within the poured concrete, is filled with a corrosion protection substance 16.

Formwork part 1', as shown in FIG. 2*a*, is constructed in the same general manner as the formwork part 1 in FIG. 1*a* and can be used where, after tensioning, a composite action is to be produced between the tendon and the surrounding concrete. In the embodiment displayed in FIGS. 2*a* and 2*b*, the section 5' of the elongated tubular sheath 2', located within the portion of the formwork in which the concrete is to be poured, receives the strand 4. Section 5' is constructed so that it bears closely around the strand 4 and is located within a conventional metal tube or sheath 18 which surrounds the strand 4 and maintains its axial movability after the concrete has set until the tensioning of the strand is effected. The end of the metal tube 18 is connected to the sheath 2' and is sealed by a sealing band 19.

After the concrete is poured and the formwork part 1' is removed, the strand 4 can be tensioned and anchored within the anchoring member 13 by wedges 15. The hollow space between the strand 4 and the metal tube 18 is filled with cement mortar 24 to produce the composite action between the strand 4 and the metal tube 18 embedded in the concrete, note FIG. 2*b*. To supply the cement mortar around the strand 4, an injection cap 21 is fitted onto the extension of the anchoring member 13 which projects into the recess 20. Initially, this projection on the anchoring member 13 is fitted into the groove 12 in the inner end face of the formwork part 1'. With the formwork part removed, the projection extends into the recess 20 formed by the recess forming part 3'. Injection cap 21 has an expanded bell-shaped part 22 which fits over and is connected to the projection on the anchoring member 13 with the connection being effected by an interior thread on the bell-shaped part and the thread on the projection which afforded the interconnection with the part 3'. The injection cap 21 includes a nozzle 23 to which an injection hose can be connected. Anchoring wedges 15 are constructed so that continuous ducts 15' are formed in the axial direction of the strand 4 through the outer surfaces of the wedges 15 so that neat cement or grout 24 can be passed through the ducts 15' into the prestressing duct formed inside the metal tube 18.

In FIGS. 3*a* and 3*b* and 4*a* and 4*b*, tendon anchoring systems similar to those shown in FIGS. 1*a* and 1*b* and 2*a* and 2*b* are displayed with one embodiment provided with the tendon without composite action and the other with composite action and the difference being that the recess forming part forms a recess in the structural component when the concrete is poured and the anchoring member is mounted on the surface of the concrete following the removal of the formwork.

Figure 3A:
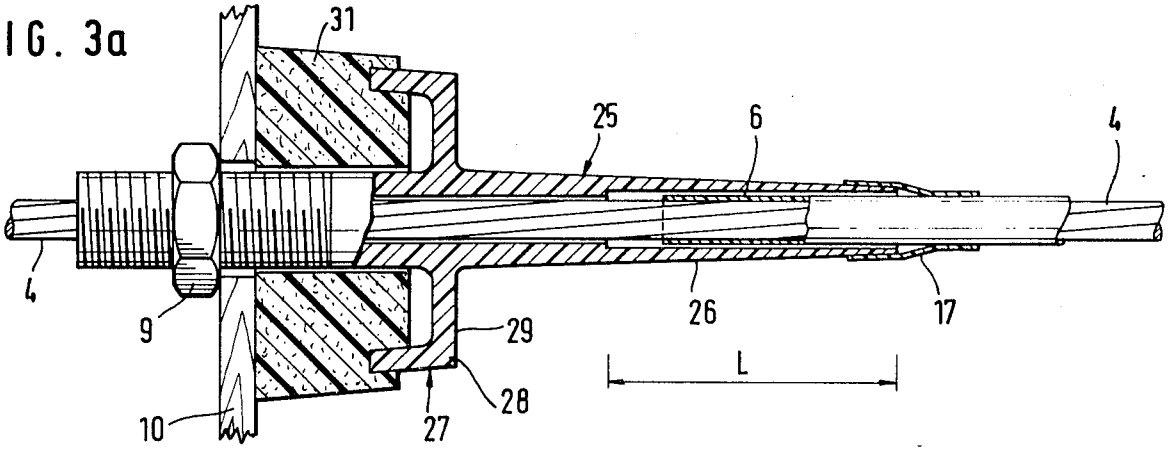
FIGS. 3*a* and 3*b* show axially extending sections through the location in which a tendon, without composite action, is anchored with a recess forming part of a different construction and with FIG. 3*b* showing an anchoring member installed after the concrete is poured.
Figure 3B:
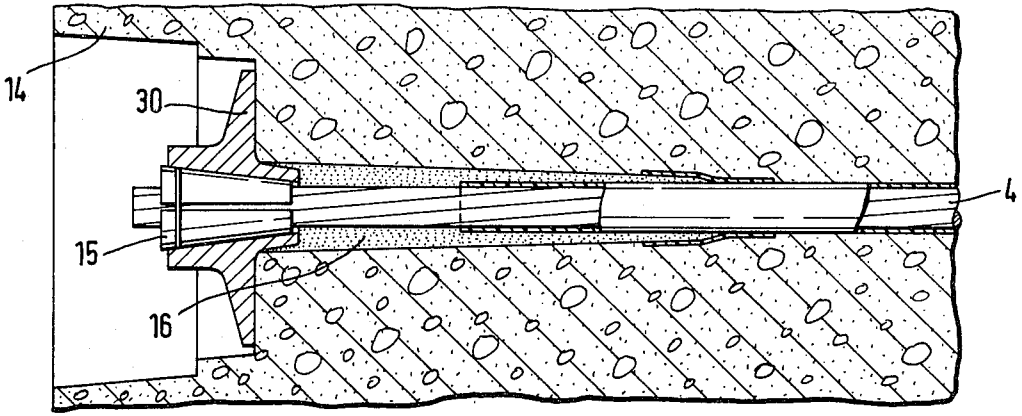

In the embodiment disclosed in FIG. 3*a*, a formwork part 25 consists of an elongated tubular sheath 26 and an integral cup-shaped part 27 which forms a part of the recess when concrete is poured into the formwork 10. When the concrete is poured, the part 27 with its inner portion 28 provides a contact surface 29 in the concrete. When the formwork is stripped, the concrete at the contact surface 29 provides a bearing surface for the anchoring member 30 which is set in place after the formwork part has been removed. In FIG. 3*b* the anchoring member 30 is shown bearing against the surface of the poured concrete and located within the recess formed in part by the cup-shaped part 27.

In FIG. 3*a* the recess formed in the concrete is provided by a different arrangement from the previously described embodiments. In addition to the cup-shaped part 27 which forms a part of the recess, an additional recess forming element 31 is positioned located between the part 27 and the inside surface of the formwork 10. Element 31 is made of a material which is easy to shape, for instance polystyrene. With this arrangement, tendons which extend at an angle other than a right angle relative to the formwork 10, a satisfactory and tight connection to the formwork is possible, since the element 31 can be provided with the desired shape by cutting or sawing.

Figure 4A:
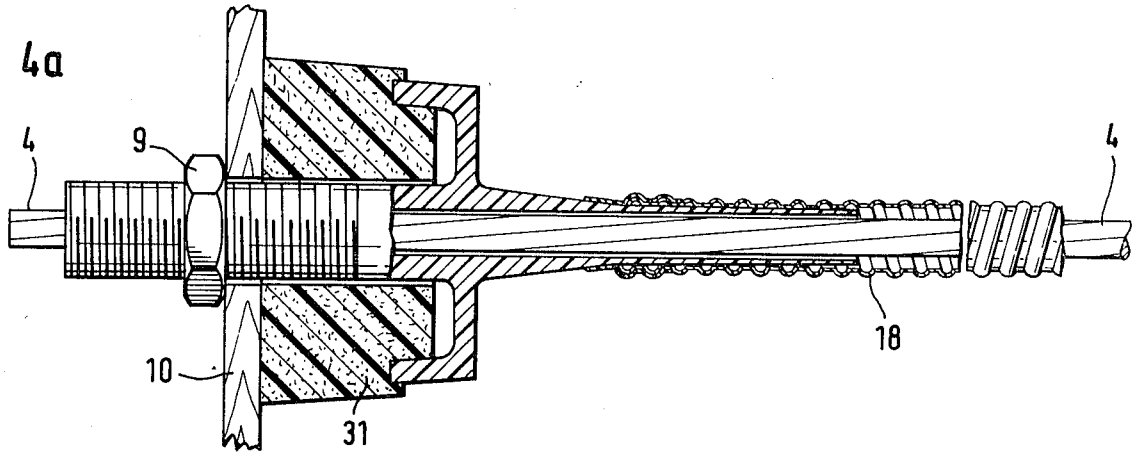
FIGS. 4*a* and 4*b* display axially extending sections, similar to FIGS. 3*a* and 3*b*, at the location at which a tendon, with composite action, is anchored and where the anchoring member is installed after the concrete is poured.
Figure 4B:
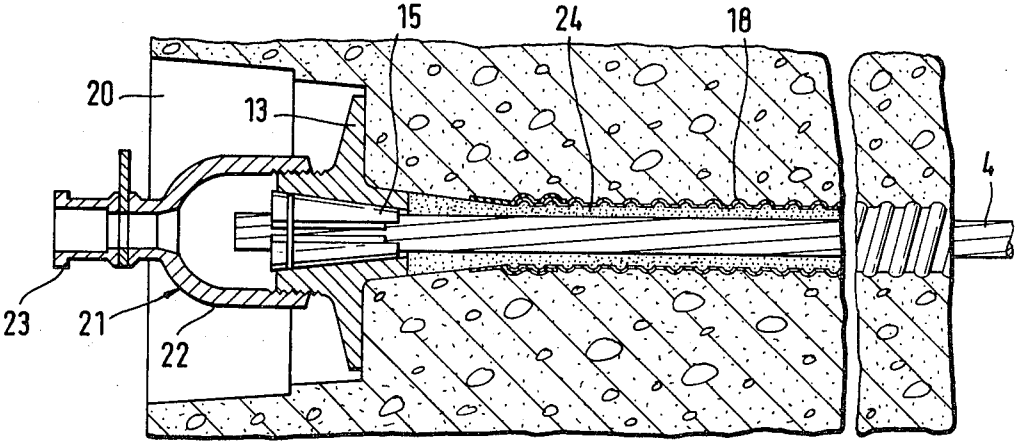

The two embodiments disclosed in FIGS. 3*a* and 3*b* and in FIGS. 4*a* and 4*b* correspond to the embodiments shown in FIGS. 1*a* and 1*b* and in 2*a* and 2*b*, respectively, with regard to the remaining figures of the structure disclosed, especially with regard to the connection of the sheath 26 to a corrosion protected tendon or to a tendon provided with an enclosing metal tube.

Figure 5A:
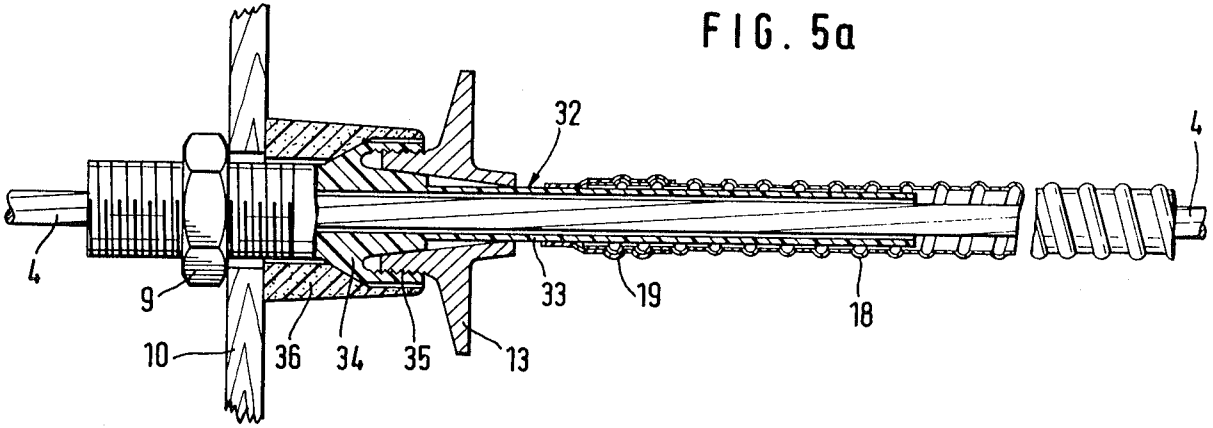
FIGS. 5*a* and 5*b* show axially extending sections through the location in which a tendon, with composite action, is anchored exhibiting another embodiment of the recess forming part and with the anchoring member embedded in the poured concrete.
Figure 5B:
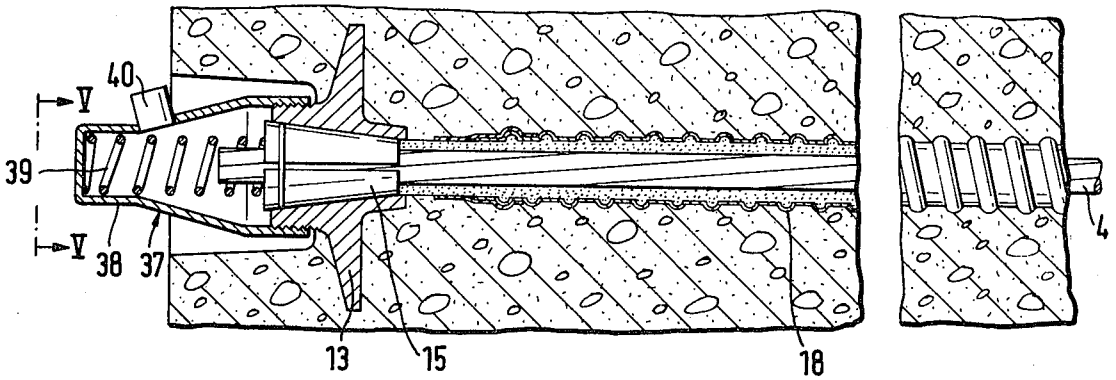

In FIGS. 5*a* and 5*b*, another embodiment of this type of tendon anchorage is shown and the arrangement of the tendon and the composite action with the concrete corresponds to the embodiment illustrated in FIGS. 2*a* and 2*b*. In this embodiment a different construction is displayed of the recess forming part. Formwork part 32, in accordance with the present invention, consists of an axially elongated sheath 33 with an increased thickness wall section 34 located in the portion of the formwork which is to provide the recess in the concrete. The end face formed by the increased thickness section 34 is large enough to include a circumferential groove 35 in which the anchoring member 13 can be secured in the same general manner as shown in FIGS. 1*a* and 2*a*. In addition, a recess element 36 laterally encircles section 34 and this element forms the surface of the recess in the concrete. Furthermore, the element 36, fitted on the section 34, affords the connection of the formwork part 32 with the formwork 10. The recess element 36 is similar to the recess elements 31 shown in FIGS. 3*a* and 4*a* in that the element can be shaped so that it can be adjusted to an angle of inclination between the strand 4 and the formwork other than a right angle. In addition, it can be provided with a different form in cross-section so that by replacing the illustrated formwork element 36 with an element having a different shape or size whereby with the same formwork part 32 different shapes and sizes of the recess can be provided.

Figure 5C:
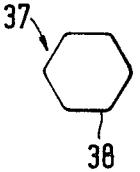
FIGS. 5*c* is an end view taken in the direction of the line V—V in FIG. 5*b*.

Another embodiment of an injection bell 37 is shown in FIG. 5*b*. After the concrete structural component is poured and the formwork is stripped, the injection bell 37 is placed on the outwardly facing projection of the anchoring member 13, similar to the bell 21 shown in FIG. 2*b*. The outer end of the injection cap 37 is closed by an end cover 38 and the end 38 has a hexagonal shape in transverse section, note FIG. 5*c*. A compression spring 39 is positioned within the injection cap 37 with the spring acting at one end against the outer end faces of the wedges 15 and at the other end against the inner face of the end 38 of the injection bell 37. The spring 39 fixes the end faces of the wedges 15 in the anchoring member 13. The injection cap 37 has a nozzle 40 located outwardly from the recess so that neat cement or a similar material can be pressed through the nozzle 40 into the space around the tendon 4.

While specific embodiments of the invention have been shown and described in detail to illustrate the application of the inventive principles, it will be understood that the invention may be embodied otherwise without departing from such principles.

What is claimed is:

1. Recoverable formwork part constituting a portion of formwork for forming a concrete structural member and the formwork part being used for forming the location at which a tendon is anchored in the structural member and at which location an anchoring member is used having a passage therethrough for the tendon, said forwork part comprising an axially elongated tubulr sheath arranged to enclose an axially extending portion of the tendon when the concrete is poured into the formwork and a cup-shaped part extending in the axially elongated direction of said sheath and arranged to form a recess within the concrete structural member when the concrete is poured into the formwork, said sheath having a first end arranged to be located within the concrete when the concrete is poured and a second end arranged to be located exteriorly of the formwork when the concrete is poured into the formwork, said cup-shaped part having a first open end facing toward the first end of said sheath and a second open end facing toward the second end of said sheath, said first end of said sheath being spaced for a considerable axial length thereof from the first end of said cup-shaped part and said second end of said sheath being spaced in the axial length direction from the second end of said cup-shaped part, said sheath arranged to enclose the tendon in closely fitting relation for a relatively long portion of the axial length of said sheath from a location at least between the first ends of said sheath and cup-shaped part to a location at least within the axial extending length of said cup-shaped part, means engageable with said sheath for securing said sheath to the formwork, said cup-shaped part integral with said sheath intermediate the first and second ends of said sheath and the first open end of said cup-shaped part being threaded therein for receiving a threaded section of the anchoring member so that the anchoring member can be screwed into the threaded first open end of said cup-shaped part for securing the anchoring member in form-locking engagement with said cup-shaped part.

2. Recoverable formwork part, as set forth in claim 1, wherein said sheath adjacent the second end thereof having an external thread thereon, and said means engageable with said sheath comprises a tie nut arranged to be screwed onto the external thread for fixing the formwork part to the formwork for forming the concrete structural member.

3. Recoverable formwork part constituting a portion of formwork for forming a concrete structural member and the formwork part being used for forming the location at which a tendon is anchored in the structural member and at which location an anchoring member is used having a passage therethrough for the tendon, said formwork part comprising an axially elongated tubular sheath arranged to enclose an axially extending portion of the tendon when the concrete is poured into the formwork and a cup-shaped part extending in the axially elongated direction of said sheath and arranged to form a recess within the concrete structural member when the concrete is poured into the formwork, said sheath having a first end arranged to be located within the concrete when the concrete is poured and a second end arranged to be located exteriorly of the formwork when the concrete is poured into the formwork, said cup-shaped part having a first end facing toward the first end of said sheath and a second end facing toward the second end of said sheath, said first end of said sheath being spaced for a considerable axial length thereof from the first end of said cup-shaped part and said second end of said sheath being spaced in the axial length direction from the second end of said cup-shaped part, said sheath arranged to enclose the tendon in closely fitting relation for a relatively long portion of the axial length of said sheath from a location at least between the first ends of said sheath and cup-shaped part to a location at least within the axial extending length of said cup-shaped part, means engageable with said sheath for securing said sheath to the formwork, said cup-shaped part secured on said sheath intermediate the first and second ends of said sheath and said sheath having an axial passage with the passage having an increased diameter from the first end for a portion of the axial length thereof toward the second end so that a tendon with a corrosion protection jacket can be fitted into the increased diameter end extending from the first end of said sheath.

4. Recoverable formwork part constituting a portion of formwork for forming a concrete structural member and the formwork part being used for forming the location at which a tendon is anchored in the structural member and at which location an anchoring member is used having a passage therethrouyh for the tendon, said formwork part comprising an axially elongated tubular sheath arranged to enclose an axially extending portion of the tendon when the concrete is poured into the formwork and a cup-shaped part extending in the axially elongated direction of said sheath and arranged to form a recess within the concrete structural member when the concrete is poured into the formwork, said sheath having a first end arranged to be located within the concrete when the concrete is poured and a second end arranged to be located exteriorly of the formwork when the concrete is poured into the formwork, said cup-shaped part having a first end facing toward the first end of said sheath and a second end facing toward the second end of said end of said sheath, said first end of said sheath being spaced for a considerable axial length thereof from the first end of said cup-shaped part and said second end of said sheath being spaced in the axial length direction from the second end of said cup-shaped part, said sheath arranged to enclose the tendon in closely fitting relation for a relatively long portion of the axial length of said sheath from a location at least between the first ends of said sheath and cup-shaped part to a location at least within the axial extending length of said cup-shaped part, means engageable with said sheath for securing said sheath to the formwork, said cup-shaped part secured on said sheath intermediate the first and second ends of said sheath, said sheath extending from the first end thereof for a portion of the axial length of said sheath having a reduced outside diameter for receiving a tubular member surrounding the tendon within the concrete structural member.

5. Recoverable formwork part constituting a portion of formwork for forming a concrete structural member and the formwork part being used for forming the location at which a tendon is anchored in the structural member and at which location an anchoring member is used having a passage therethrough for the tendon, said formwork part comprising an axially elongated tubular sheath arranged to enclosed an axially extending portion of the tendon when the concrete is poured into the formwork and a cup-shaped part extending in the axially elongated direction of said sheath and arranged to form a recess within the concrete structural member when the concrete is poured into the formwork, said sheath having a first end arranged to be located within the concrete when the concrete is poured and a second end arranged to be located exteriorly of the formwork when the concrete is poured into the formwork, said cup-shaped part having a first end facing toward the first end of said sheath and a second end facing toward the second end of said sheath, said first end of said sheath being spaced for a considerable axial length thereof from the first end of said cup-shaped part and said second end of said sheath being spaced in the axial length direction from the second end of said cup-shaped part, said sheath arranged to enclose the tendon in closely fitting relation for a relatively long portion of the axial length of said sheath from a location at least between the first ends of said sheath and cup-shaped part to a location at least within the axial extending length of said cup-shaped part, means engageable with said sheath for securing said sheath to the formwork, said cup-shaped part secured on said sheath intermediate the first and second ends of said sheath, and a recess element formed of a material which is easily shaped and said recess element being mounted on said cup-shaped part so that said recess element extends between said cup-shaped part and the formwork when the formwork part is assembled in the formwork.

* * * * *